US005944575A

United States Patent [19]

Tolnay

[11] Patent Number: 5,944,575

[45] Date of Patent: Aug. 31, 1999

[54] BUILDING PLAYTHING PRIMARILY FOR CREATING ROLLING TRACKS

[76] Inventor: Judit Fuchsné Tolnay, Kankalin u. 9, É rd H--2030, Hungary

[21] Appl. No.: 09/011,186

[22] PCT Filed: Aug. 30, 1996

[86] PCT No.: PCT/HU96/00047

§ 371 Date: Feb. 2, 1998

§ 102(e) Date: Feb. 2, 1998

[87] PCT Pub. No.: WO97/07866

PCT Pub. Date: Mar. 6, 1997

[30] Foreign Application Priority Data

Aug. 30, 1995 [HU] Hungary ..... 9500230 U

[51] Int. Cl.[6] ..... A63H 29/08; A63H 33/04; A63H 33/08

[52] U.S. Cl. ..... 446/168; 446/89; 446/128

[58] Field of Search ..... 446/128, 127, 446/89, 168, 169, 170, 173

[56] References Cited

U.S. PATENT DOCUMENTS

| | | | |
|---|---|---|---|
| 2,000,808 | 5/1935 | Williams . | |
| 2,532,521 | 12/1950 | Stair . | |
| 3,237,512 | 3/1966 | Beverett | 446/170 X |
| 4,429,487 | 2/1984 | Taylor et al. | 446/168 |
| 4,553,749 | 11/1985 | Bender et al. | 446/168 X |
| 5,344,143 | 9/1994 | Yule | 446/128 X |
| 5,564,962 | 10/1996 | Espinosa | 446/128 |

FOREIGN PATENT DOCUMENTS

| | | | |
|---|---|---|---|
| 441982 | 3/1927 | Germany . | |
| 1478451 | 5/1969 | Germany | 446/128 |
| 2757531 | 7/1979 | Germany | 446/168 |
| 90/14142 | 11/1990 | WIPO | 446/89 |

*Primary Examiner*—D Neal Muir
*Attorney, Agent, or Firm*—Birch, Stewart Kolasch & Birch, LLP

[57] ABSTRACT

A building plaything comprising building elements, connected in a known way and produced in module size or in any multiple thereof, for creating rolling tracks, upon the building elements a rolling groove is shaped and directrix of the rolling groove is straight or arched or slanting, and the plaything comprising connecting elements to be joined to the building elements in the known way, and the building elements are shaped as at least one of the following elements: as straight element, as slanting element, as arched element, the plaything furthermore comprising a rolling element wherein the rolling groove is shaped with slanting sides having an obtuse angle to one another, further, for the purpose that the slanting element can be placed also at right angle to any of the building elements gradient of the slanting side of the rolling groove of the building elements is the same as the gradient of the directrix of the slanting element.

5 Claims, 3 Drawing Sheets

BUILDING PLAYTHING PRIMARILY FOR CREATING ROLLING TRACKS

This application is the national phase under 35 U.S.C. § 371 of prior PCT International Application No. PCT/HU96/00047 which has an International filing date of Aug. 30, 1996 which designated the United States of America, the entire contents of which are hereby incorporated by reference.

The invention relates to a building plaything for creating primarily rolling tracks out of which building plaything several types of rolling tracks can be made through utilizing building elements of various forms.

BACKGROUND OF THE INVENTION

These days, numerous types of different building playthings are known. The common feature of all these is that through assembling identical or several types of different building elements various objects can be assembled. One of the most widespread playthings of this kind is the building plaything known as "LEGO". With that, and with playthings of similar kind, particular objects can be assembled out of several kinds of minute building elements which elements are, however, identical by sort.

With this sort of building playthings the point of the playing is the assembling that develops the combinatory skills of children to a major extent. However, the assembled objects are suitable for further playing, with a very few exceptions, only to a limited extent, and further use is not a target upon assembly either.

In addition to the building elements, generally additional accessories have to be used for proper shaping of the various objects, the accessories usually being prefabricated pieces. Through their application, children will learn how to use building elements as modules but it will provide no genuine construction experience because no more has to be performed in each instance than inserting the particular piece prefabricated at the module level.

With other types of building playthings through assembly a structure or object suitable for further utilization is created. Here the aim of the game, in addition to assembling, is shaping a serviceable structure to be suitable for further playing. Such a building plaything is shown in the patent specification and drawings of the U.S. Pat. No. 5,344,143, which is a marble run game comprising building elements used as block elements. Each of the block elements has a top surface and at least one side surface and these surfaces define the groove for travel of a marble. The groove, as shown in the figures, can determine straight, curved, spiral, sloped etc. runs of the marble. In such playthings the main problems are that the run of the marble is either too slow or too fast, further the marble has sometimes an unwanted tottering sideways motion which in fact spoil the play and cause the complete failure of the plaything. The same disadvantage occurs with the plaything shown in the figures of the U.S. Pat. No. 5,344,143. Here, the shape of the cross-section of the groove is a semicircular arch. The marble is supported on one point of the groove and, for this reason, it can have an unrequired to-and-fro sideways motion which results in a drop in speed.

SUMMARY OF THE INVENTION

The object of the invention is to implement a building plaything and with the plaything rolling tracks of various shapes in optional forms can be implemented through fitting various building elements and accessory elements side by side and which plaything is free from the drawbacks above mentioned.

It has been recognized that, with a rolling groove shaped with slanting sides having an obtuse angle to one another, the problem above mentioned can be solved. A further recognition of the invention is that, with the use of such a shape of the rolling groove, much more interesting combinations of assemblings can be made, than with the use of other shapes of the groove.

The invention is, therefore, a building plaything, primarily for creating rolling tracks comprising building elements connected in a known way, produced in module size or in any multiple thereof, a rolling groove is shaped on the building elements and directrix of the rolling groove is straight or arched and/or slanting, and the building elements are shaped as straight elements and/or arched elements and/or slanting elements, and the plaything, in a given case, comprising connecting elements to be joined to the building elements in the known way, the plaything furthermore comprising a rolling element wherein the rolling groove is shaped with slanting sides having an obtuse angle to one another. The joining in the known way means for example that the connecting elements are supplied with a connecting point, in a given case, a connecting pin, and a nest to accept the point or pin, and the building elements are supplied with connecting points for being connected to one another and/or to the connecting elements and/or with a nest to accept the points.

The material of the building elements and the connecting elements is preferably plastic or wood.

The solution according to the invention will be hereinafter described and illustrated in the attached figures.

DETAILED DESCRIPTION OF THE INVENTION

Figure 1:
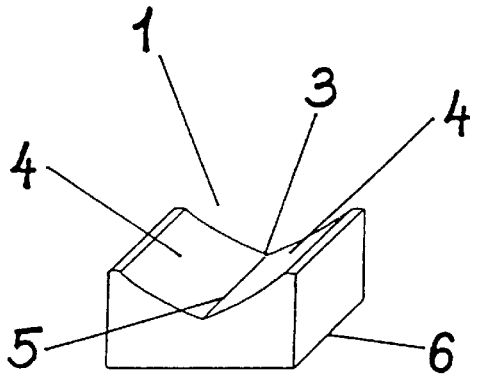
In FIG. 1 a building element shaped as a straight element of the building plaything according to the invention is shown.

In FIG. 1, the building element 1 shaped in module size as the straight element 6 of the building plaything according to the invention can be seen. The sides 4 at an obtuse angle to one another of the upper part of the building element 1 constitute the rolling groove 3, the directrix 5 situated in the bottom part of the rolling groove 3 is straight in this exemplary embodiment, subsequently the rolling groove 3 is also straight. The straight element 6 is further characterized by the rolling groove 3 being at the same level at both ends of the building element 1. As it produces no fall, it can be fitted side by side several times at the same level as a continuation of such elements. The sides 4 are slightly curved surfaces as shown in the figure, deviating from the plane which allows the secure lead of the rolling element 10 and hold to the direction.

Figure 2:
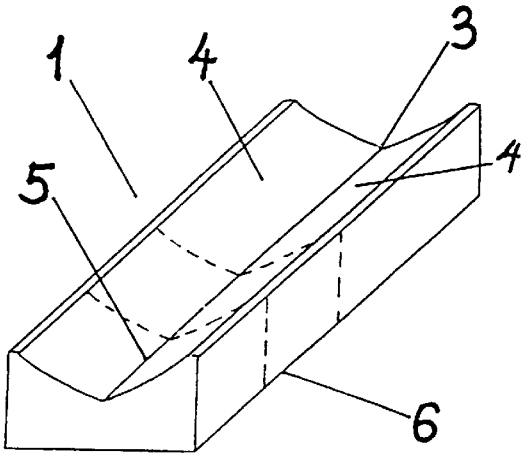
In FIG. 2 a building element shaped as a straight element elongated in multiple module size of the building plaything according to the invention is shown.

In FIG. 2 the building element 1 is shown shaped as a straight element 6 of the building plaything according to the invention, elongated in multiple module size. In this exemplary embodiment the directrix 5 situated at the bottom part of the sides 4 and, jointly with the directrix 5, the rolling groove 3 itself are also straight while their length is equal to the multiple, preferably to the double, triple or quadruple of the module size. With such a long straight element 6, both ends of the rolling groove 3 are at identical level. That allows proper fitting of further elements.

Figure 3:
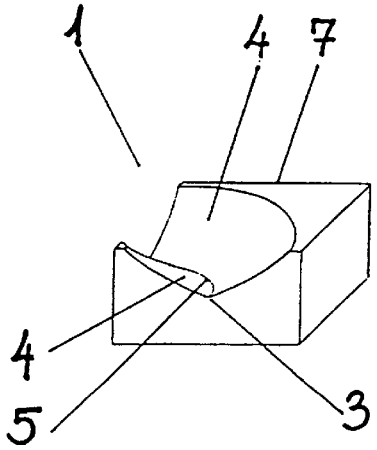
In FIG. 3 a building element shaped as an arched element of the building plaything according to the invention is shown.

In FIG. 3, the building element 1 shaped as an arched element 7 of the building plaything according to the invention can be seen. The directrix 5 situated at the bottom part of the rolling groove 3, and subsequently the sides 4 themselves, are arch shaped. In the figure, the rolling groove 3 turns 90° within the module size. As a matter of fact, other turns of angle, e.g. 45°, may also occur. In this case, the rolling groove 3 has to be assembled carefully to make sure that the properly fitting building element 1 be put beside the arched element 7, also that the rolling groove 3 properly fit between the building elements 1.

Figure 4:
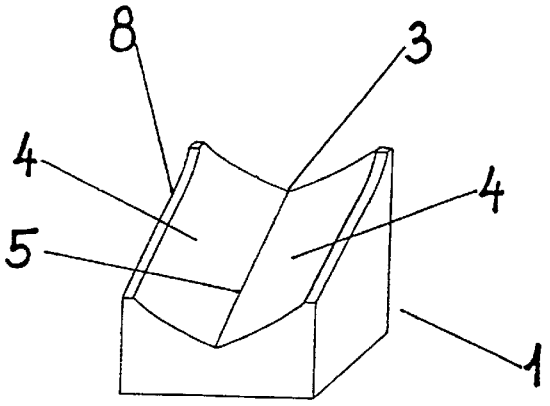
In FIG. 4 a building element shaped as a slanting element of the building plaything according to the invention is shown.

In FIG. 4, the building element 1 shaped as a slanting element 8 of the building plaything according to the invention can be seen in module size. The directrix 5, and jointly with the directrix, the rolling groove 3 bordered by sides 4 are, in this case, shaped within the module size in slanting form. The rolling groove 3 is one connecting element 2 height higher at one end than at the other end. At assembling this allows the shaping of slanting parts of shorter or longer length, as well as, locating the slanting element 8 in front of or behind a straight element 6, or arched element 7.

Figure 5:
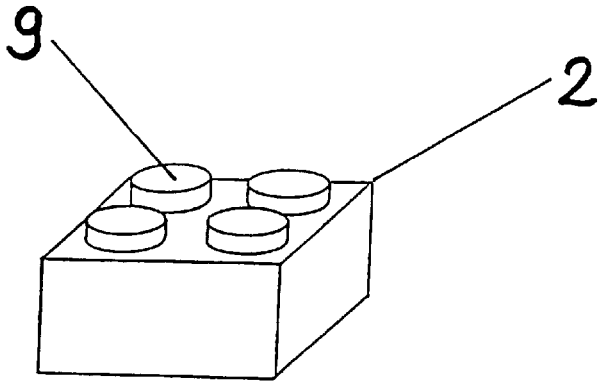
In FIG. 5 a connecting element for joining the building elements is shown.

In FIG. 5, the connecting element 2 for joining to the building elements 1 is shown. The module size of the connecting element 2 is equal to that of the building element 1. However, it is supplied at its upper part with connecting point 9, or in the given case, connecting pin, and at its bottom part nest to take the point or pin. Through the points or pins, it can be connected to the building elements 1 or to one another.

Figure 6:
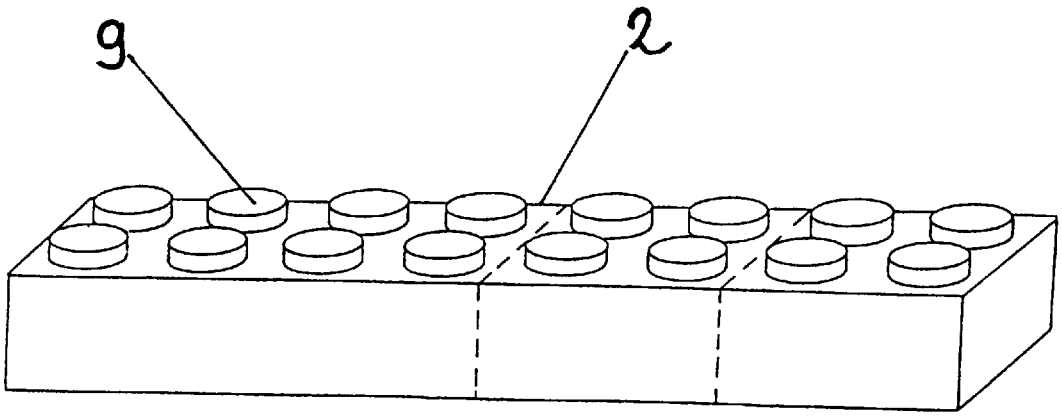
In FIG. 6 a connecting element elongated in multiple module size for joining the building elements is shown.

In FIG. 6, the connecting element 2, elongated in multiple module size, for joining to the building element 1 is shown. Such shaping of the connecting element 2 allows forming the rolling groove 3 in a highly stable and secure way. The length of the connecting element 2 is preferably equal to the multiple, preferably to the double, triple or quadruple of the module size.

Figure 7:
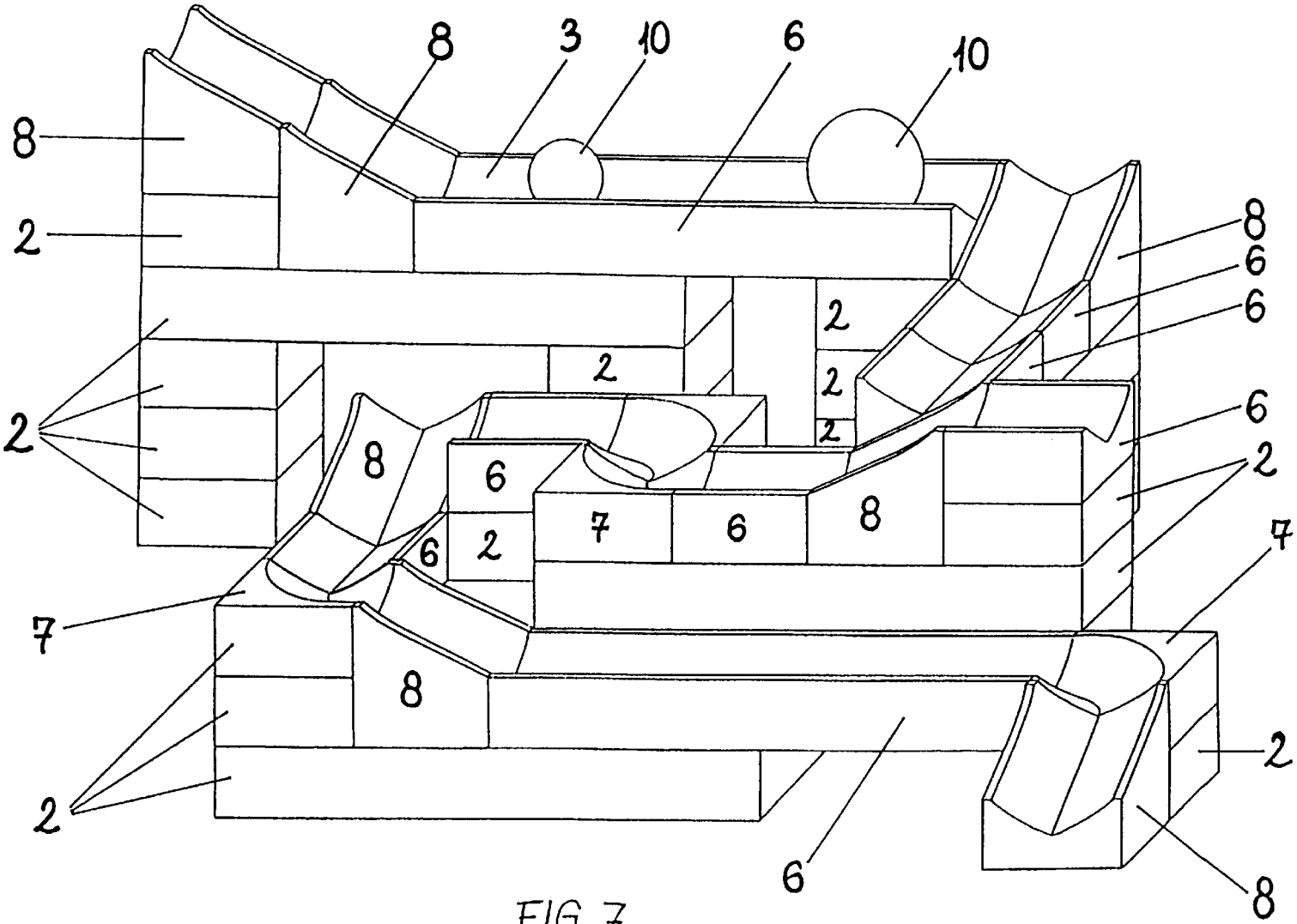
In FIG. 7 an exemplary assembly of the rolling track can be seen with the application of the building elements, according to the invention.

In FIG. 7, an exemplary assembly of the rolling track can be seen with the application of the building elements 1, according to the invention. In the figure, the short and long straight elements 6, arched elements 7, slanting elements 8, and the short and long connecting elements 2 to join the elements, and the rolling elements 10 put in the rolling groove 3 are shown. In the figure, it can be seen that there are plenty of various forms of both putting the building elements 1 side by side and shaping the specific form of the rolling groove that allows forming rolling tracks of various subtly subject to the playing child's fantasy.

The first part of the use of the building plaything according to the invention is assembling. At this point, through the given connecting form the joining of the building elements 1 is performed, and the rolling track is shaped in a specific form. It is subsequent to that that the actual use is performed during the course of the use the rolling element 10 rolls along the rolling groove 3. Rolling elements 10 of various sizes may also be used because the sides 4 will provide proper lead and support with several diameters. Between the sides 4, the angle is obtuse.

For the plaything, rolling elements 10 of the widest range of kinds and material can be used, for example steel, plastic, glass, wood bails, and also their size may vary to a great extent.

In a particular embodiment, as the plaything is produced primarily for little children, it is important that the building elements 1 have no sides with an edge or border, also that the corners, tips are made blunt. Therefore, at the side of the rolling groove 3, the building elements 1 have preferably a blunt border and the border will not affect the rolling of the rolling elements 10.

The advantage of the plaything according to the invention is that in addition to developing the constructing skills of children, it also provides direct experience of playing, and success. The shaped rolling track can be actually tested. Thus the property of the assembly can be directly ascertained by children. The connectibility of the building elements 1, on the other hand, allows numerous options for making changes. The rolling of the rolling element 10 facilitates encountering the laws of physics which makes children's playing experience more intensive.

I claim:

1. A building plaything system comprising:

at least one rolling element; and at least a first group and a second group of building elements, each building element of said second group having modular sizes, each first group building element being connectable with a building element of either said first group or said second group, said first group including building elements having fastening devices on one side thereof, said second group including:

building elements each having a substantially planar base side which has an aperture therethrough and said aperture being engageable with said fastening devices, each second group building element having a track on an opposite side of a respective substantially planar base side, each track being capable of supporting said at least one rolling element, each second group building element being one of a straight element, an inclined element, and an arched element;

each track includes a pair of slanting sides, each slanting side being disposed at a first angle relative to a respective substantially planar base side, each slanting side being disposed at a second angle relative to an opposing slanting side, said second angle being an obtuse angle, each track of each inclined element being disposed at a third angle relative to a respective substantially planar base side, each third angle being substantially equal to each first angle, when at least one of a straight element and arched element is disposed adjacent to an inclined element in a substantially perpendicular manner, said rolling element is moveable across respective bordering track elements in a substantially smooth manner while side-to-side translational movement of said rolling element within each track is substantially reduced.

2. The system of claim 1, wherein each building element of said first group has a modular size, and modular sizes of said first group of building elements are substantially equal to modular sizes of said second group of building elements.

3. The system of claim 1, wherein each third angle has a magnitude where a first end of a respective inclined element has a height which is substantially one module size higher than a second end of a respective inclined element.

4. The system of claim 1, wherein an outside edge of each slanting side of a track is substantially blunt.

5. The system of claim 1, wherein each slanting side of each second group building element has a slightly curved surface.

* * * * *